US006966994B2

(12) United States Patent
Berns et al.

(10) Patent No.: US 6,966,994 B2
(45) Date of Patent: Nov. 22, 2005

(54) CONTAMINATION CONTROL FOR ENGINES

(75) Inventors: Daniel D. Berns, Washington, IL (US); Carmen L. Rose, Macomb, IL (US)

(73) Assignee: Caterpillar Inc, Peoria, IL (US)

( * ) Notice: Subject to any disclaimer, the term of this patent is extended or adjusted under 35 U.S.C. 154(b) by 164 days.

(21) Appl. No.: 10/072,868

(22) Filed: Feb. 12, 2002

(65) Prior Publication Data

US 2002/0148788 A1 Oct. 17, 2002

Related U.S. Application Data

(60) Provisional application No. 60/283,936, filed on Apr. 17, 2001.

(51) Int. Cl.[7] ..... B01D 37/04; G01N 15/06

(52) U.S. Cl. ..... 210/745; 210/85; 210/143; 210/416.5; 73/53.07; 73/865.5; 368/70; 123/196 S

(58) Field of Search ..... 210/745, 85, 143, 210/168, 416.5; 73/53.07, 61.42, 61.71, 862, 73/865.5; 123/196 A, 196 S; 356/70, 335, 356/336

(56) References Cited

U.S. PATENT DOCUMENTS 3,049,964 A * 8/1962 Miller et al. ..... 356/70
3,910,702 A 10/1975 Corll
4,015,135 A 3/1977 Tipton, Jr.
4,129,034 A 12/1978 Niles et al.
4,376,637 A 3/1983 Yang
4,496,460 A * 1/1985 Haarstad et al. ..... 210/132
4,565,448 A 1/1986 Abbott et al.
4,623,252 A 11/1986 Hollenbeck
4,830,494 A 5/1989 Ishikawa et al.
4,871,251 A 10/1989 Preikschat et al.
4,984,889 A 1/1991 Sommer
5,090,808 A 2/1992 Ishikawa et al.
5,365,559 A 11/1994 Hsueh et al.
5,572,320 A 11/1996 Reintjes et al.
5,788,827 A 8/1998 Munson
5,870,190 A 2/1999 Unger
5,968,371 A 10/1999 Verdegan et al.
5,987,972 A 11/1999 Hirota et al.
6,049,381 A * 4/2000 Reintjes et al. ..... 356/335
6,151,108 A * 11/2000 Kwon et al. ..... 356/70
6,582,661 B1 * 6/2003 Pardue et al. ..... 422/68.1

FOREIGN PATENT DOCUMENTS

GB 2101330 A * 1/1983

* cited by examiner

*Primary Examiner*—Frank M. Lawrence
(74) *Attorney, Agent, or Firm*—Finnegan, Henderson, Farabow, Garrett & Dunner

(57) ABSTRACT

A method is provided of detecting contamination of engine fluid in an engine. Engine fluid is provided to a particle counter, and the cleanliness of the engine fluid is measured with the particle counter during operation of the engine.

63 Claims, 4 Drawing Sheets

CONTAMINATION CONTROL FOR ENGINES

RELATED CASES

This application claims priority from the provisional application, entitled "Contamination Control for Engines," Ser. No. 60/283,936, filed on Apr. 17, 2001.

TECHNICAL FIELD

This invention relates to the field of engines, and more specifically, a system for and method of preventing engine damage by detecting particles in an engine fluid, such as engine oil.

BACKGROUND

There is an industry perception that particle counting is not practical in a running engine environment due to, inter alia, build up of soot in the engine oil. In the prior art, several methods exist for determining soot buildup. In one prior art method, particles in diesel engine oil are counted by cutting open the oil filter and visually counting the particles after an engine dynamometer test procedure. In another method, a bottle sampler is utilized to catch oil samples. The samples are then visually examined for clues as to contamination or spectrographically analyzed. These methods allow for the counting of particles large enough to be seen by the human eye, but fails to detect debris circulating in an engine oil system while the engine is running, for instance in a dynamometer test.

A problem with the known prior art method is the cost associated with not detecting particles smaller than what an oil filter catches. Current oil filters do not catch all of the particles that can cause engine wear; they only catch large particles. This may shorten the life of the engine and result in higher repair costs.

An additional problem with the prior art method is the inability to detect harmful levels of particles in the engine until after an oil change. This delay can cause damage to the engine and result in high repair costs.

The present invention is directed to overcoming one or more of the problems or disadvantages associated with the prior art.

SUMMARY OF THE INVENTION

One aspect of the present invention is directed to a method of detecting contamination of engine fluid in an engine. Engine fluid is provided to a particle counter, and characteristics of the cleanliness of the engine fluid is measured with the particle counter during operation of the engine.

In another aspect of the present invention, a system is provided for measuring contamination in the engine fluid of a running engine. The system includes a source of engine fluid, a particle counter attached to the source, and a drain for draining the engine fluid from the particle counter.

In another aspect of the present invention, a filtration system for cleaning engine fluid during an engine dynamometer test is provided. The filtration system includes an external pump for drawing engine fluid from the engine and an external filter through which the pump draws the engine fluid.

In another aspect of the present invention, a system is provided for detecting contaminants in engine fluid of a running engine and cleaning the contaminants. The system includes a filtration system for cleaning the engine fluid and a particle counter attached to a source of engine fluid.

In another aspect of the present invention, a method is provided of detecting contamination in engine fluid and cleaning engine fluid in a running engine. The method first includes measuring the cleanliness of the engine fluid during a test cycle. Next, a filtration system is operated for a first period of time in the test cycle. After operation of the filtration system, corrective action is taken during a second period of time in the test cycle when the characteristics of the cleanliness of the engine fluid reaches a threshold level.

In another aspect of the present invention, a system is provided for detecting contaminants in engine fluid from a running engine and cleaning the contaminants. The system includes a filtration system having an external pump for drawing the engine fluid from the engine and an external filter through which the pump draws the engine fluid. The system further includes a particle counter system attached to a source of engine fluid. The particle counter system includes an optical particle counter and a computer for displaying particle count information, the computer being in communication with the particle counter.

In another aspect of the present invention, a method of measuring and analyzing the health of an engine is provided. Engine fluid is provided to a particle counter, and characteristics of the cleanliness of the engine fluid is measured with the particle counter during operation of the engine.

BRIEF DESCRIPTION OF THE DRAWINGS

The accompanying drawings, which are incorporated in and constitute a part of this specification, illustrate one embodiment of the invention and together with the description, serve to explain the principles of the invention.

DETAILED DESCRIPTION

Embodiments consistent with the present invention, provide an engine fluid filtration system and a particle counter, either alone or in combination, to clean, analyze, and/or monitor engine fluid within an engine. In exemplary embodiments, the engine fluid may be oil. An exemplary body consistent with the present invention permits the monitoring and analysis of contamination within the engine fluid to establish the health of the engine.

Figure 1:
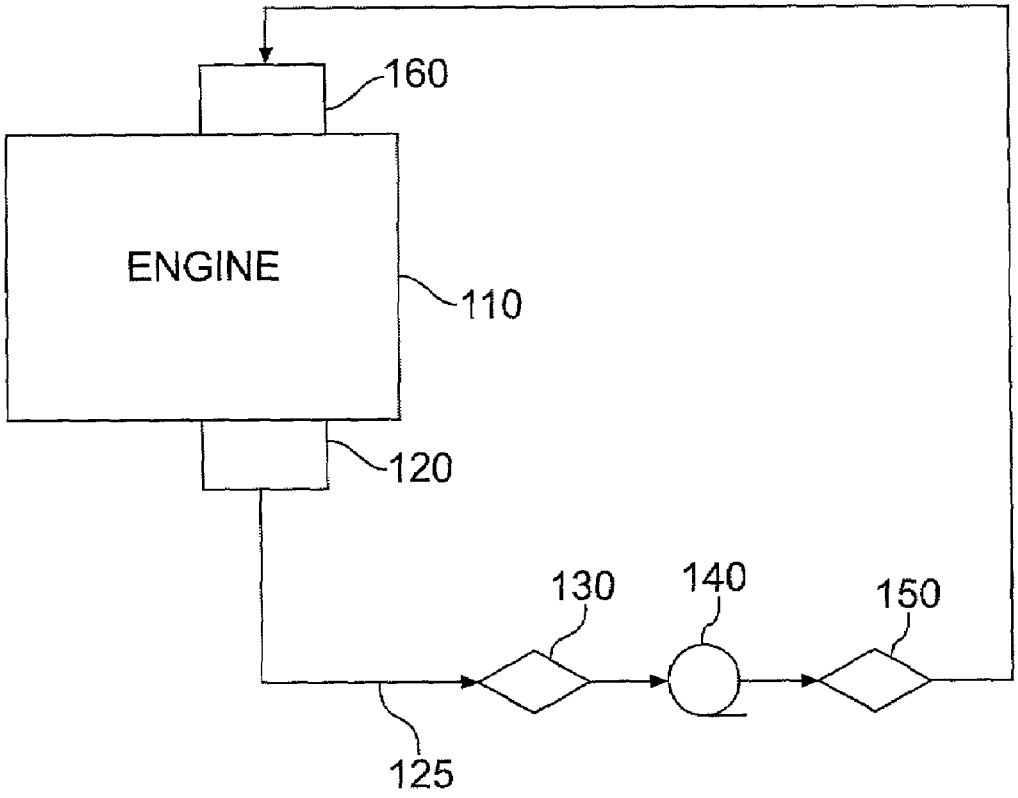
FIG. 1 is a block diagram illustrating a filtration system in which features and principles of an embodiment of the present invention may be implemented.

FIG. 1 is a block diagram illustrating a filtration system in which features and principles of the present invention may be implemented. The present invention may include a filtration system for cleaning engine fluid, such as oil, and an external particle counter for measuring the cleanliness of the engine fluid. The filtration system may be external to the running engine and may be a kidney loop filtration system. In one embodiment of the invention, the filtration system draws fluid from the engine pan, pumps it through a first and second filter, and returns the fluid to the fill tube of the engine or back to the engine oil pan in the case of oil being the measured fluid.

As illustrated in FIG. 1, engine 110 has an engine oil system in fluid communication with fill tube 160 and oil pan 120. In the illustrated embodiment of the invention, engine oil is drawn from engine 110 through oil pan 120 via hose 125. The oil pan provides unfiltered engine oil to the filtration system. Those skilled in the art will appreciate that filtered engine oil could also be sent to the filtration system. Hose 125 may be an appropriately dimensioned diameter hose or pipe.

An oil pump 140 draws the engine oil through a first filter 130 placed prior to the oil pump 140. In the exemplary embodiment of the invention, the first oil filter 130 is a 5 micron filter, which may be placed prior to the pump 140 in order to eliminate larger particles. A second oil filter 150 may be placed after the oil pump 140 to remove smaller particulate from the oil. In the exemplary embodiment of the invention, the second oil filter 150 may be a 2 micron filter. After passing through second oil filter 150, the engine oil is returned to the engine 110 through fill tube 160. Those skilled in the art will appreciate that the filtration system consistent with embodiments of the present invention may be arranged in other fashions in order to accomplish the goal of oil filtration.

While the filtration system consistent with embodiments of the present invention is useful for removing particles from engine oil that the internal filter of an engine oil filter would miss, another feature consistent with embodiments of the present invention is the addition of a particle counter to an engine for counting the particles present in an engine. The particle counting may occur prior to, during, or after filtering. It is also contemplated that the addition of a particle counter to an engine would be useful regardless of whether an external filtration system is utilized.

Figure 2:
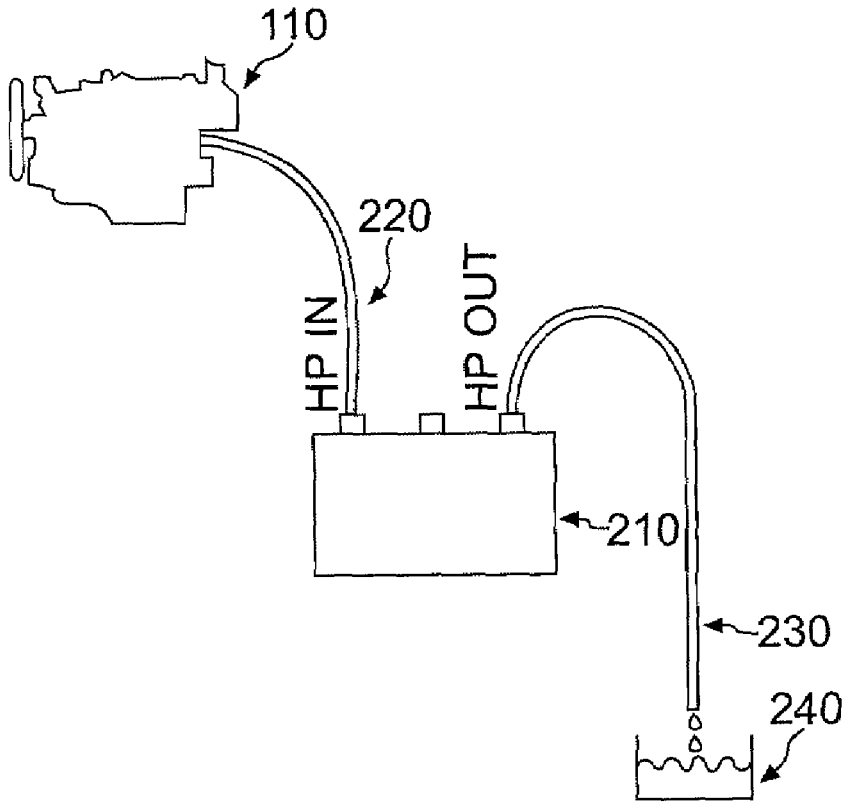
FIG. 2 illustrates, diagrammatically, an engine attached to a particle counter system in which features and principles of an embodiment of the present invention may be implemented.

FIG. 2 illustrates, diagrammatically, an engine attached to a particle counter system in which features and principles of an embodiment of the present invention may be implemented. In attaching the particle counter 210 to the engine 110 running the dynamometer test, one embodiment of the invention attaches the particle counter 210 to the unfiltered side of the engine oil filter of the engine 110. In this way, a more accurate assessment of engine oil contamination may be made over an alternative embodiment that attaches to the filtered side of the engine oil filter. Particle counter 210 feeds the tested oil through drain line 230 to drain bottle 240, where it is later disposed of. Alternatively, the fluid may be recirculated to the engine.

In an embodiment utilizing a Pamas OLS-2 particle counter, the particle counter 210 may be set to a high pressure position during operation. In an embodiment, the particle counter 210 and feed line 220 from the engine 110 to the particle counter 210 may be fully purged prior to taking a reading from the particle counter 210. In one embodiment consistent with the present invention, the particle counter 210 and feed line are purged of three times the volume of fluid within the particle counter 210 and feed line 220. In an exemplary embodiment, when the particle counter 210 is placed 90 inches from the engine using a 6 mm internal diameter feed line and pumping at a rate of 25 ml/minute, the particle counter is purged for 90 seconds.

The particle counter of one embodiment of the present invention is a Pamas OLS-2 particle counter. This particle counter is in communication with a computer system and is able to store and display particle count information, or associated information, to an operator. The particle counter operates by shining a beam of light through an engine oil sample placed between glass (or other transparent) surfaces. The absorption of the light is measured and used to calculate the size and amount of particles within the fluid stream. This particle count translates to a level of contamination within the engine fluid being tested. While an optical particle counter is described, those skilled in the art will appreciate that other online particle counting systems may be substituted.

The particle counter of one embodiment of the present invention is able to identify the size of particles detected. The particle sizes may be determined, analyzed, stored and/or categorized as small, medium, and large. Particles parameters, e.g. the quantity, size, and rate of production of particles, either alone or in combination, are characteristics of the cleanliness of the engine fluid and may be used as an indicator of the health, status, failure, or predictive failure of the engine. For example, a gradual increase in particles in the fluid may indicate a slow failure of the engine may occur. For another example, a drastic increase in large particles may be an indication of an instantaneous failure of the engine.

A monitoring and analysis process consistent with an exemplary embodiment of the present invention may consist of one or more measuring and filtering periods. During a first measurement period, the particle counter can be monitoring and measuring particle parameters that are characteristics of the cleanliness of the engine fluid. In the exemplary embodiment, no filtering is occurring during the first period, so that an analysis of the quality of the engine build can be determined. However, should the characteristics of the cleanliness exceed a threshold during this first period, the filtering may be initiated, either automatically, prompted to an operator by the process, or by the operator upon viewing the characteristics.

During a second measurement period, the particle counter may be run along with the filter. This second measurement period may be for a set period of time, or the time period may be determined by the process based on the one or more characteristics of cleanliness of the fluid.

During a third measurement period, the particle counter may be activated without any filtering present. This permits monitoring the health of the engine after the initial particle count has been reduced by the second measurement period. If the characteristics of cleanliness indicate a decrease in cleanliness over time, the engine may be malfunctioning and corrective action can be taken. For instance, a rise in particle count over time or an increase in count above a threshold value may be an indication of malfunction. The process may automatically shut the engine down, take such corrective action as necessary, or notify the operator of the malfunction for the operator to take action. Thus, the process' examination of the rate of change of characteristics of cleanliness provides predictive indications of engine health to prevent engine failure.

In addition to the rate of change of the characteristics, particular characteristics lead to information about engine health. For instance, the detection of small particles in the engine fluid may be an indication of a slow failure that may occur over a period of time. The rapid detection of large particles may be an indication of an instantaneous failure. Also, while a small, linear increase in particles over time may be the result of normal engine break-in, an exponential increase in particles over time may indicate an engine failing over time.

Further measurement periods may be utilized as deemed appropriate to clean and analyze the engine health. For instance, a final filtration period may be run to reduce the particle count to below a threshold level.

Figure 3:
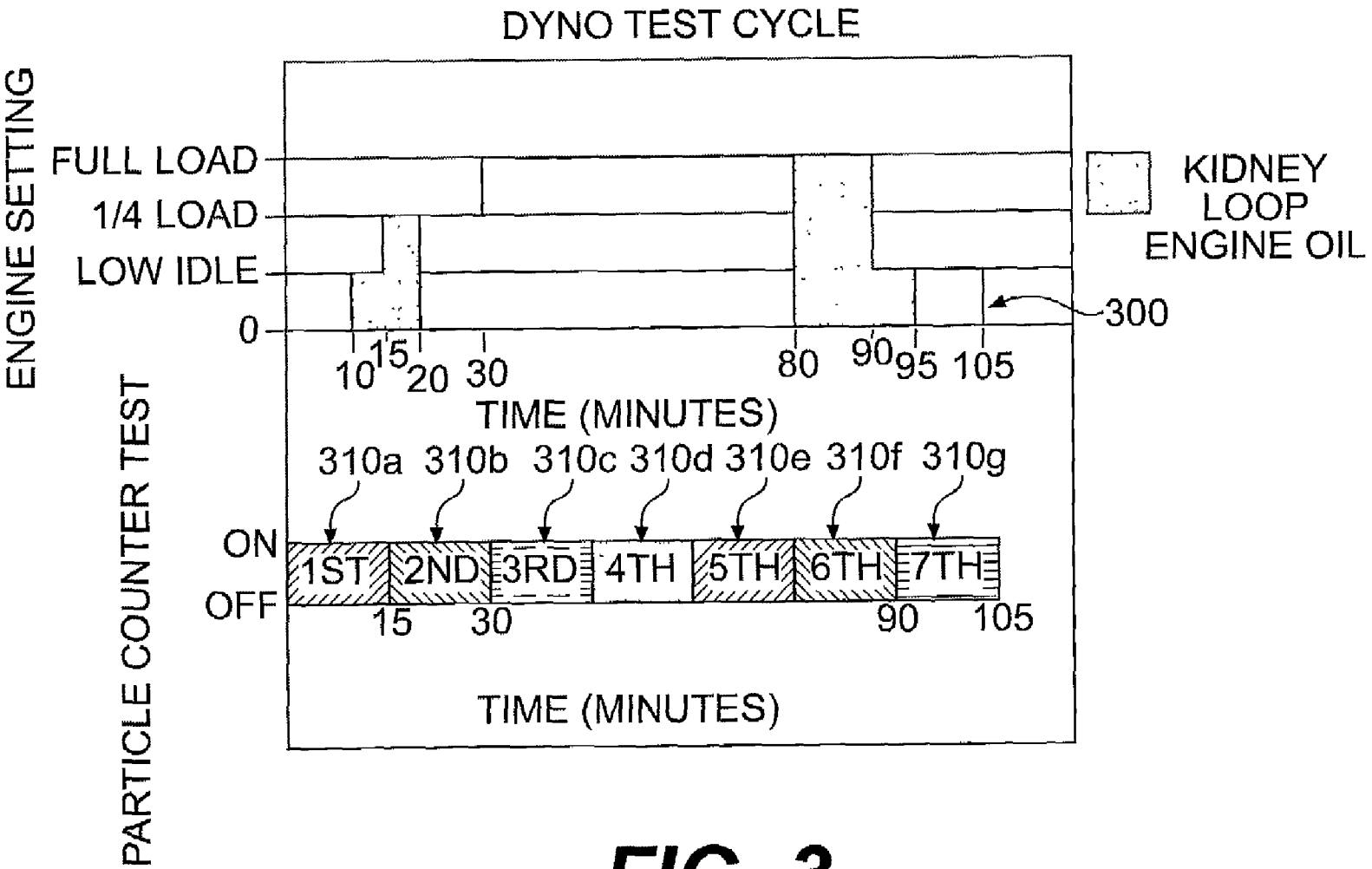
FIG. 3 is a graph of a dynamometer test cycle implemented according to the features and principles of an embodiment of the present invention.

FIG. 3 is a graph of a dynamometer test cycle implemented according to the features and principles of the present invention. The dynamometer test cycle 300 illustrated is for an implementation consistent with an embodiment of the present invention utilizing both the filtration system and the particle counting system. Black shaded portions of dynamometer test cycle 300 illustrate those phases in the cycle during which a filtration system is in operation. Illustrated beneath the dynamometer test cycle 300 is a graph showing that a total of seven particle counter test cycles 310*a*–310*g* are taken during the course of the dynamometer test cycle 300. The particle counter system may be operated continuously during the course of the dynamometer test in order to gain knowledge as to the initial cleanliness of the engine, critical particle buildup within the engine, and final cleanliness of the engine. While a dynamometer test cycle of 105 minutes is illustrated, those skilled in the art will appreciate that longer, short cycles, or the number of cycles may be appropriate depending on the type of engine, engine history, filtration system, and other factors, such as past experience, dictate.

At time t=0 seconds, the dynamometer test begins with the engine load set to a low idle and particle counter test cycle 310*a* commencing. The engine is run at low idle for a ten minute period of time with no filtration occurring. This allows the operator of the system to ascertain the initial cleanliness of the engine from the first particle counter test cycle 310*a*. This is an indication of how well the engine was assembled. As the operator observes this test cycle, or any test cycle, he may choose to shut down the dynamometer test if a high particle count is indicated by the particle counting system, or the system may automatically perform a shutdown based on particle parameters. Unlike prior art particle counting accomplished by cutting open an oil filter after a test and counting particles, systems consistent with the present invention allow for the detection and prevention of catastrophic failures through its feedback of particle parameters.

At time t=10 minutes, the filtration system is activated to clean the particulate out of the engine oil. The engine remains at low idle with the filtration system in operation, until time t=15 minutes. At this time, the first particle test cycle 310*a* is completed and a second particle test cycle 310*b* is begun. In addition, the engine is brought to ¼ load and filtration continues until time t=20 minutes. The engine load is increased in this fashion in order to flush additional particulates out of the system. Fluid flows at a given rate, say at low idle engine speed, form eddies and currents. These eddies at a first, or low flow rate, trap particles, which are not released from inside the engine until a change in engine load dictates a change in fluid oil flow. The change in fluid oil flow will form a different set of eddies, thus releasing particles previously trapped at the lower flow rate.

The engine continues to run at a ¼ load until time t=30 minutes, when the second particle test cycle 310*b* is completed, with a new particle test cycle 310*c* begun, and the engine is brought to full load for a period of time. In the illustrated dynamometer test cycle 300, the engine is run at full speed until time t=90 minutes; however shorter or longer durations may be desirable depending on the engine and cleanliness variables observed. Through the full load portion of the dynamometer test cycle, additional particle test cycles 310*c*–310*f* are taken. In this embodiment, because the filtration process may not be initiated until the last ten minutes of the full load portion of the cycle 300, potential failures caused by particle buildup can be detected and prevented. Of course, it may be advantageous in certain circumstances to not delay the operation of the filtration process to the last ten minutes. During the last ten minute period of full load, time t=80 minutes to t=90 minutes, the filtration system is operated to remove particles built up during the cycle.

At time t=90 minutes, the engine is brought back to low idle until time t=95 minutes and the filtration system continues to run to remove particles jettisoned following the speed changes. At time t=95 minutes, the filtration system is turned off, so that the last ten minutes of the cycle allow analysis and monitoring of final engine cleanliness.

The above process may be repeated as needed in order to further test the engine, or remove further particles. In addition, the above process could be implemented with the filtration system not in place if an examination of the engine is desired without the presence of external filtering.

Figure 4:
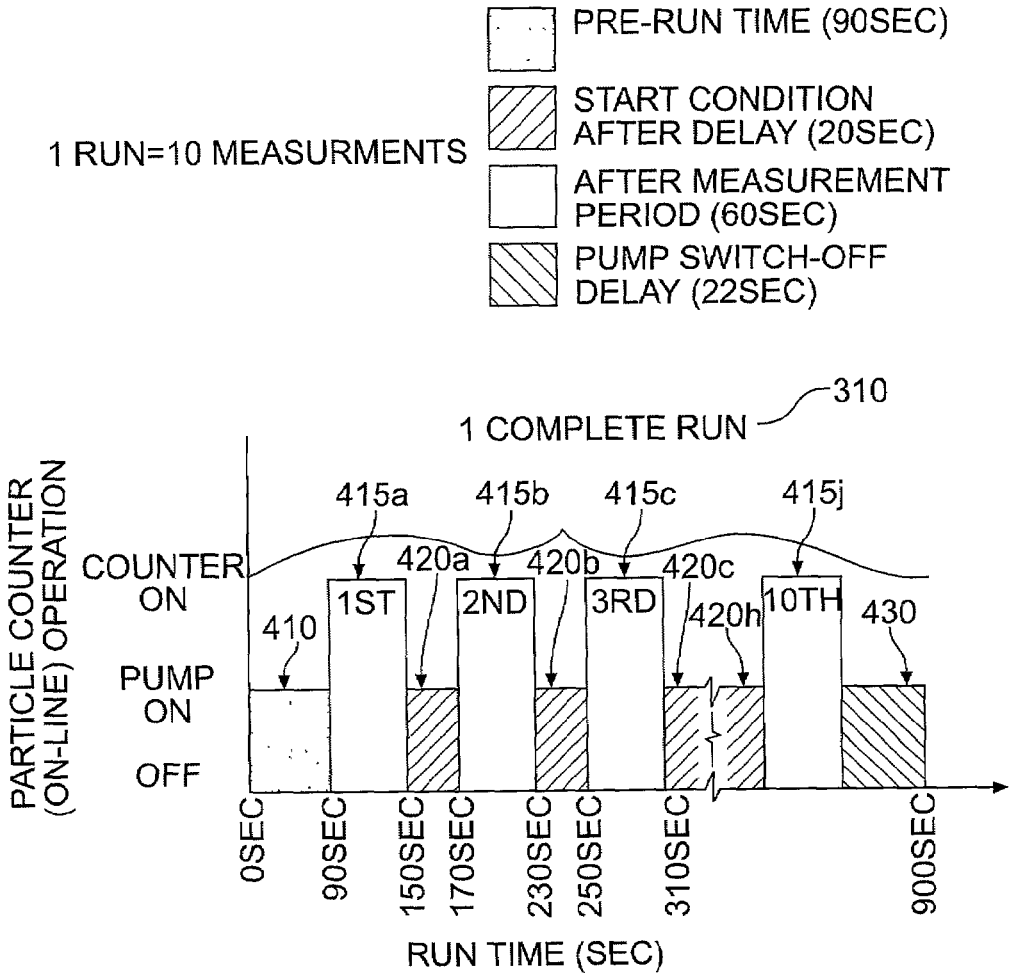
FIG. 4 illustrates the operation of the particle counter during a particle test cycle.

FIG. 4 illustrates the operation of the particle counter during a particle test cycle 310. At pre-run time 410, the particle counter performs no counting operation, but merely flushes the oil through the particle counter, dumping the oil to the drain bottle. This serves to purge the feed line and particle counter, so an actual sample from the engine is tested. At time, t=90 seconds, a particle count is taken over a 60 second measurement cycle 415*a*. This is followed by further cycles of 20 second short purges 420*a*–420*h* interspersed between 60 second measurement cycles 415*b*–415*j*. Following the tenth measurement cycle 415*j*, the pump is switched off 430. Thus ten measurements are made in each particle test cycle 310.

INDUSTRIAL APPLICABILITY

This invention is for use in any environment where testing of contaminants in an engine fluid is desired. By means of example only, the present invention may be used in dynamometer testing of new or rebuilt industrial diesel engines. In addition, the present invention may also be used, for example, in testing of new or rebuilt, gasoline engines, aircraft engines and marine engines. While the exemplary embodiment is described in connection with engine oil, other embodiments of the present invention may include any type of fluid utilized in an engine.

Those skilled in the art are concerned about soot in the oil interfering with an optical particle counter. One way in which the soot problem is avoided is by operating the particle counter on new or newly rebuilt engines. The particle counter system of the present invention has been found to operate in a satisfactory manner on these engines. In a test of the system, an engine was run for an eight hour period with no filtration present on the system, the highest soot value measured during this test was 12 percent of the allowable soot value for the particle counter. The results of this test indicate that the particle counter system of the present invention may also be used on engines that are not new or newly rebuilt. Therefore, the method and system of the present invention are applicable to engines in general.

Systems consistent with the present invention may be composed of the particle counting system for measuring particulate in the oil, the filtration system for removing contamination from the oil, or a combination of these two systems. When used in combination, the system operates to clean the engine oil and also to analyze and monitor for particle information that yield information on engine health. Thus, the system can both sense a problem and take corrective action to remedy that problem. In addition, the results of the system analysis may be used to provide recommendations to an engine builder regarding the building process, for instance, providing a cleaner environment or providing cleaner engine fluid to the engine initially. Alternatively, the system may be able to provide the recommendations to the builder based on the particle parameters.

For instance, the results of a particle count may be compared to a threshold value. Should the particle count exceed the threshold, indicating that the engine is not as clean as desired, the filtrations system may be activated, or reactivated, for filtering the oil. The filtration system may be activated until such time as the particle count drops below the threshold level. In addition, if a malfunction criteria is met, such as an increase in particle count over a period of time or a particle count in excess of a threshold value, a control function of the system may automatically shut the engine down, thereby preventing major engine damage.

In one embodiment, when the filtration system is used in conjunction with the particle counter, the flow rate of the filtration system may be high enough to remove particulates from the oil, but low enough to prevent air bubbles from being formed in the oil. Such bubbles may yield faulty readings in the particle counter.

The results of the measurements made in the present invention may be displayed in graphical or tabular form. In addition, the particle counter may be in communication with a computer system for logging the results of each dynamometer test cycle. Engine logs may be maintained for each engine and compared to other engines, particularly engines of an analogous type. It is contemplated that an operator may enter engine information into the computer system, and the computer system would use an internal database to set up the dynamometer, kidney filtration system, and particle counter system parameters. For instance, if an operator enters in the computer system that engine type X is to be tested, the internal computer system may instruct the operator that the purge line is to be of a particular length, instruct the particle counter of the appropriate purge times, and establish dynamometer parameters, all of which are particular to engine type X. In addition, the computer system may display guideline cleanliness parameters for that particular engine type, so that the operator knows when the engine cleanliness is out of tolerance. The computer system may automatically perform a shut down of the dynamometer process, activate the filtration system upon detection of out of tolerance cleanliness parameters, or provide analysis to operators.

It will be readily apparent to those skilled in this art that various changes and modifications of an obvious nature may be made, and all such changes and modifications are considered to fall within the scope of the appended claims. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A method of detecting contamination of engine fluid in an engine, comprising:

providing engine fluid to a particle counter;

measuring a characteristic of cleanliness of the engine fluid with the particle counter during operation of the engine in a dynamometer test; and initiating operation of a filtration system coupled to the engine to clean the engine fluid when the characteristic of cleanliness measured with the particle counter exceeds a threshold value.

2. The method of claim 1, further including displaying the characteristic of cleanliness to an operator.

3. The method of claim 1, further including halting the dynamometer test based on the characteristic of cleanliness of the engine fluid.

4. The method of claim 1, wherein the characteristic of cleanliness is selected from one of a particle count, a particle size, and a rate of particle accumulation.

5. The method of claim 1, wherein the engine fluid is unfiltered.

6. The method of claim 2, wherein initiating operation of the filtration system includes initiating operation of the filtration system in response to a command received from the operator.

7. The method of claim 1, wherein initiating operation of the filtration system includes initiating operation of the filtration system automatically in response to the characteristic of cleanliness exceeding the threshold value.

8. A method of detecting contamination of engine fluid in an engine, comprising:

providing engine fluid to a particle counter;

measuring a characteristic of cleanliness of the engine fluid with the particle counter during operation of the engine;

initiating operation of a filtration system coupled to the engine to clean the engine fluid when the characteristic of cleanliness measured with the particle counter exceeds a threshold value; and identifying a characteristic of a quality of build of the engine based on an analysis of the characteristic of the cleanliness of the engine fluid.

9. The method of claim 8, further including displaying the characteristic of the quality of build to an engine builder.

10. A method of detecting contamination of engine fluid in an engine, comprising:

providing engine fluid to a particle counter;

measuring a characteristic of cleanliness of the engine fluid with the particle counter during operation of the engine; and making recommendations to an engine builder based on an analysis of the characteristic of the cleanliness of the engine fluid.

11. A system for measuring contamination in engine fluid of an engine, comprising:

a source of engine fluid;

a particle counter attached to the source of engine fluid from the engine for measuring a characteristic of cleanliness of the engine fluid;

a drain for draining the engine fluid from the particle counter;

a filtration system in fluid communication with the engine for filtering and returning engine fluid from the engine, wherein the filtration system is initiated when the characteristic of cleanliness measured by the particle counter exceeds a threshold value; and a computer system for identifying a characteristic of a quality of build of the engine based on an analysis of the characteristic of the cleanliness of the engine fluid.

12. The system of claim 11, wherein the filtration system is initiated by an operator when the characteristic of cleanliness measured by the particle counter exceeds a threshold value.

13. The system of claim 11, wherein the filtration system is a kidney loop filtration system.

14. The system of claim 11, wherein the filtration system further includes:

an external pump for drawing the engine fluid from the engine; and an external filter through which the pump draws the engine fluid.

15. The system of claim 11 wherein the particle counter is an optical type particle counter.

16. The system of claim 11, further including a computer for displaying particle count information, said computer being in communication with the particle counter.

17. The system of claim 11, wherein the external filter is placed upstream of the external pump and removes particulate of a first size from the engine fluid.

18. The system of claim 17, further including a second external filter placed downstream of the external pump, the second external filter removing particulate of a second size, smaller than the first size, from the engine fluid.

19. A method of detecting contamination in engine fluid and cleaning engine fluid in a running engine, comprising:

measuring characteristics of the cleanliness of the engine fluid during a test cycle in which the engine is run at varying loads; and variably operating a filtration system based on the varying loads.

20. The method of claim 19, further comprising halting the running of the engine when a malfunction criteria is met.

21. The method of claim 20, wherein the malfunction criteria includes a decrease in engine cleanliness over time.

22. The method of claim 19, wherein the characteristic of cleanliness is selected from one of a particle count, a particle size, and a rate of particle accumulation.

23. A system for detecting contaminants in engine fluid from a running engine during an engine dynamometer test, comprising:

a filtration system for cleaning the engine fluid, the filtration system having:

an external pump for drawing the engine fluid from the engine; and an external filter through which the pump draws the engine fluid; and a particle counter system including an optical particle counter, wherein information derived from the particle counter system is used to determine a characteristic of cleanliness of the engine fluid during operation of the engine at a plurality of engine loads during the dynamometer test.

24. In a system having a particle counter and a filtration system, a method of analyzing the health of an engine and cleaning engine fluid during operation of the engine, comprising:

providing engine fluid to a particle counter during a first time period;

operating the particle counter to measure a characteristic of cleanliness of engine fluid in the engine during the first time period; and initiating operation of the filtration system during the first period if the characteristic of cleanliness measured by the particle counter exceeds a threshold value during the first time period.

25. The method of claim 24, wherein the characteristic of the cleanliness of the engine fluid is selected from one of a particle count, a particle size, and a rate of particle accumulation.

26. The method of claim 24, further comprising analyzing the health of the engine based on the characteristic of cleanliness during the first time period.

27. A method of analyzing the health of an engine, comprising:

providing engine fluid to a particle counter;

measuring a characteristic of the cleanliness of the engine fluid with the particle counter during operation of the engine;

analyzing the health of the engine based on the characteristic of cleanliness; and making recommendations to a builder of the engine based on the health of the engine.

28. The method of claim 24, further comprising:

providing engine fluid to the particle counter during a second time period; and measuring the characteristic of the cleanliness of the engine fluid with the particle counter during operation of the engine during the second time period.

29. The method of claim 28, further comprising filtering the engine fluid with the filtration system during the second time period to clean contaminants from the engine fluid.

30. The method of claim 29, wherein a duration of the second time period is based on a preset time value.

31. The method of claim 29, wherein a duration of the second time period is based on the characteristic of the cleanliness of the engine.

32. The method of claim 29, further comprising analyzing the health of the engine based on the characteristic of cleanliness during the second time period.

33. The method of claim 32, further comprising providing an indication of a malfunctioning engine if the characteristic of cleanliness is a particle count and if the particle count rises above a threshold value over a period of time.

34. The method of claim 32, further comprising halting the engine if the health of the engine indicates a malfunction.

35. The method of claim 29, further comprising operating the particle counter without the filtration system during a third time period to monitor the health of the engine after the engine fluid has been cleaned during the second period of time.

36. A method of detecting engine fluid contamination in an engine, comprising:

varying a load at which the engine is run according to a criteria;

providing engine fluid from the engine to a particle counter while varying the load; and measuring a characteristic of cleanliness of the engine fluid with the particle counter.

37. The method of claim 36, further comprising:

activating a filtration system for a latter portion of a first cycle in which the engine is run at low idle;

activating the filtration system during an initial portion of a second cycle in which the engine is run at an increased load;

activating the filtration system for a latter portion of a third cycle in which the engine is run at full speed; and activating the filtration system during an initial portion of a fourth cycle in which the engine is run at low idle.

38. The method of claim 36, wherein varying the load at which the engine is run includes varying the load during an engine dynamometer test.

39. The method of claim 35, further comprising determining when a malfunction criteria is met.

40. The method of claim 39, wherein the malfunction criteria includes a decrease in engine cleanliness over time.

41. The method of claim 39, wherein the malfunction criteria includes a detection of large particles.

42. The method of claim 39, wherein the malfunction criteria includes an increase in particles over time.

43. The method of claim 39, further comprising halting operation of the engine when the malfunction criteria is met.

44. The method of claim 1, further comprising determining when a malfunction criteria is met.

45. The method of claim 44, wherein the malfunction criteria includes a decrease in engine cleanliness over time.

46. The method of claim 44, wherein the malfunction criteria includes a rapid detection of large particles.

47. The method of claim 44, further comprising taking corrective action when the malfunction criteria is met.

48. The method of claim 47, wherein taking corrective action includes halting operation of the engine.

49. The system of claim 23, wherein the filtration system operates during the dynamometer test based on the plurality of loads at which the engine is operated during the dynamometer test.

50. The method of claim 8, further including displaying the characteristic of cleanliness to an operator.

51. The method of claim 50, wherein initiating operation of the filtration system includes initiating operation of the filtration system in response to a command received from the operator.

52. The method of claim 8, further including operating the engine in a dynamometer test during the measuring and halting the dynamometer test based on the characteristic of cleanliness of the engine fluid.

53. The method of claim 8, wherein the characteristic of cleanliness is selected from one of a particle count, a particle size, and a rate of particle accumulation.

54. The method of claim 8, wherein the engine fluid is unfiltered.

55. The method of claim 8, wherein initiating operation of the filtration system includes initiating operation of the filtration system automatically in response to the characteristic of cleanliness exceeding the threshold value.

56. A method of detecting contamination of engine fluid in an engine, comprising:

providing engine fluid to a particle counter;

measuring a characteristic of cleanliness of the engine fluid with the particle counter during operation of the engine; and identifying a characteristic of a quality of build of the engine based on an analysis of the characteristic of the cleanliness of the engine fluid.

57. The method of claim 56, further including displaying the characteristic of cleanliness to an operator.

58. The method of claim 56, further including operating the engine in a dynamometer test during the stage of measuring the characteristic of cleanliness of the engine fluid.

59. The method of claim 58, further including halting the dynamometer test based on the characteristic of cleanliness of the engine fluid.

60. The method of claim 56, wherein the characteristic of cleanliness is selected from one of a particle count, a particle size, and a rate of particle accumulation.

61. The method of claim 56, wherein the engine fluid is unfiltered.

62. The method of claim 56, further including displaying the characteristic of the quality of build to an engine builder.

63. The method of claim 56, further comprising halting the operation of the engine when a malfunction criteria is met.

* * * * *